US005083706A

United States Patent [19]

Bratchell

[11] Patent Number: 5,083,706

[45] Date of Patent: Jan. 28, 1992

[54] CONCRETE SLEEPER WITH EAST-IN INSERT COOPERATING WITH A FASTENER ASSEMBLY

[75] Inventor: Robert L. Bratchell, Piccadilly, Australia

[73] Assignee: Amatek Limited, Chatswood, Australia

[21] Appl. No.: 532,870

[22] Filed: Jun. 4, 1990

Related U.S. Application Data

[63] Continuation-in-part of Ser. No. 301,620, Jan. 24, 1989, Pat. No. 4,946,099.

[30] Foreign Application Priority Data

Jan. 28, 1988 [AT] Austria ..... PI6463

[51] Int. Cl.[5] ..... E01B 9/18

[52] U.S. Cl. ..... 238/265; 238/264; 238/351; 238/349; 238/270

[58] Field of Search ..... 238/264, 265, 282, 310, 238/319, 349, 351, 331, 315, 318, 106, 270, 321, 338, 350

[56] References Cited

U.S. PATENT DOCUMENTS

| | | | |
|---|---|---|---|
| 905,867 | 12/1908 | Girard | 238/265 X |
| 1,018,538 | 2/1912 | Wilde | 238/265 |
| 1,588,628 | 6/1926 | Sellers | 52/709 |
| 1,667,532 | 4/1928 | Carlson | 52/710 |
| 1,933,536 | 11/1933 | Awbrey | 72/105 |
| 2,579,373 | 12/1951 | Edee | 238/346 |
| 3,147,921 | 9/1964 | Delcroix | 238/310 |
| 3,282,506 | 11/1966 | Holstein | 238/287 |
| 3,858,804 | 1/1975 | Hixson | 238/264 |
| 4,470,543 | 9/1984 | Gray et al. | 238/341 |
| 4,505,428 | 3/1985 | Matsuo et al. | 238/349 |
| 4,756,477 | 7/1988 | Schumaker | 238/315 |
| 4,946,099 | 8/1990 | Bratchell | 238/264 |

FOREIGN PATENT DOCUMENTS

| | | |
|---|---|---|
| 1137752 | 10/1962 | Fed. Rep. of Germany . |
| 2324152 | 6/1974 | Fed. Rep. of Germany . |
| 2409510 | 9/1975 | Fed. Rep. of Germany . |
| 433135 | 12/1911 | France . |
| 638730 | 6/1928 | France . |
| 114110 | 7/1975 | German Democratic Rep. . |
| 116482 | 11/1975 | German Democratic Rep. . |
| 988860 | 4/1965 | United Kingdom . |

*Primary Examiner*—Frank E. Werner
*Assistant Examiner*—James Eller
*Attorney, Agent, or Firm*—Brown, Martin, Haller & McClain

[57] ABSTRACT

A fastener assembly for a railroad concrete sleeper wherein an insert is embedded in the concrete and extends across the sleeper, the insert having flanges which form between them a mouth of a T-slot over a wider space below the flanges and having surfaces which key it into the concrete, and a retaining block having a tail which bears upwardly against the undersurface of the flange which lies beneath a rail foot, and a head which bears downwardly on the upper surface of the other flange outboard of the rail foot, the head having an aperture extending through it in a direction also across the sleeper, and a bent rod type fastener is retained by the aperture and bears downwardly both on the rail foot and on the block head.

6 Claims, 2 Drawing Sheets

10
11
11
11
12
14
15
16
17
18
19
20
2
2
2

16
17
18
18
19
20
20
21
22
23
24
25
26
27
28
30

CONCRETE SLEEPER WITH EAST-IN INSERT COOPERATING WITH A FASTENER ASSEMBLY

This specification accompanies a Continuation-in-Part application in respect to the co-pending patent application 07/301620 entitled "SLEEPER CONSTRUCTION", and filed in the United States Patent Office on the 24th of January 1989, now Pat. No. 4,946,099.

In that specification there was described and claimed a concrete sleeper which had an elongate metal insert embedded in the concrete of the sleeper and extending in the direction of the length of the sleeper, the insert having a cruciform sectional shape to provide means whereby it was keyed into the concrete of the sleeper, and the insert having side walls terminated along their upper edges in inturned flanges forming a T-slot extending for the length of the insert. A pair of rail retaining blocks were provided each with an upper portion bearing downwardly on the flanges, an inverted T-head in the T-slot bearing upwardly against the flanges, and a stem joined the upper portion and the inverted T-head. The upper portion had an aperture for receiving a rail clip, and the arrangement was such that a rail clip would bear downwardly on a rail foot and also on the upper portion of the retaining block so as to permanently retain the rail foot to the sleeper. In order to prevent lateral movement of the rail foot, after assembly is completed the extending portion of the T-slot of the insert was filled grout.

The system described in that application has been particularly successful and has two basic functions, the first being the provision of the ability for on-site lateral adjustment to the positioning of track fastenings without drilling or compromising the integrity of the prestressed concrete, and the second being that the system provided an excellent means for gauge conversion, for example from broad gauge to standard gauge, because the retaining blocks could be simply reversed and positioned over an adjacent rail foot flange of an adjacent rail without the need for reworking a sleeper.

The main object of this invention is to provide an alternative and simplified construction which is useful in the second of the abovenamed functions, that is, making provision for simply positioning a second rail by reversal of a retaining block.

BRIEF SUMMARY OF THE INVENTION

Briefly, the invention can be described as a fastener assembly for a railroad concrete sleeper wherein an insert is embedded in the concrete and extends across the sleeper, the insert having flanges which form between them a mouth of a T-slot over a wider space below the flanges and having surfaces which key it into the concrete, and a retaining block having a tail which bears upwardly against the undersurface of the flange which lies beneath the a rail foot, and a head which bears downwardly on the upper surface of the other flange outboard of the rail foot, the head having an aperture extending through it in a direction also across the sleeper, and a bent rod type fastener is retained by the aperture and bears downwardly both on the rail foot and on the block head.

Although the insert extends across the rail and not along it, and it therefore can reduce the strength of the rail, the arrangement is very simple, and its cost is much less.

BRIEF SUMMARY OF THE DRAWINGS

An embodiment of the invention is described hereunder in some detail with reference to and as illustrated in the accompanying drawings in which.

DETAILED DESCRIPTION OF THE PREFERRED EMBODIMENT

Figure 1:
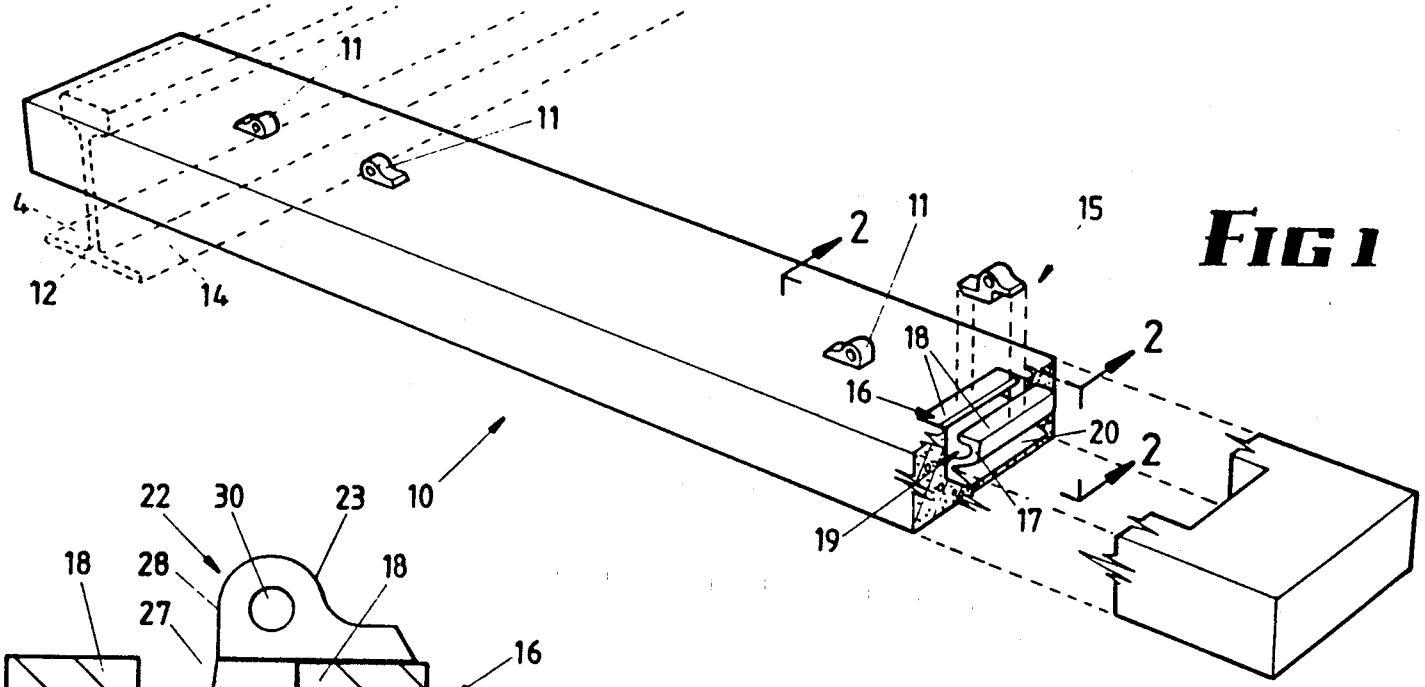
FIG. 1 is a perspective view which diagrammatically illustrates a sleeper which employs the invention.
Figure 3:
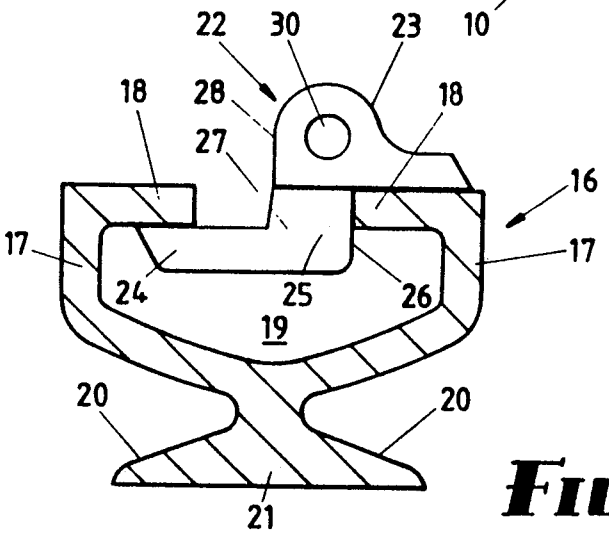
FIG. 3 is a section showing a metal insert and a retaining block, drawn to a larger scale than the other figures.
Figure 2:
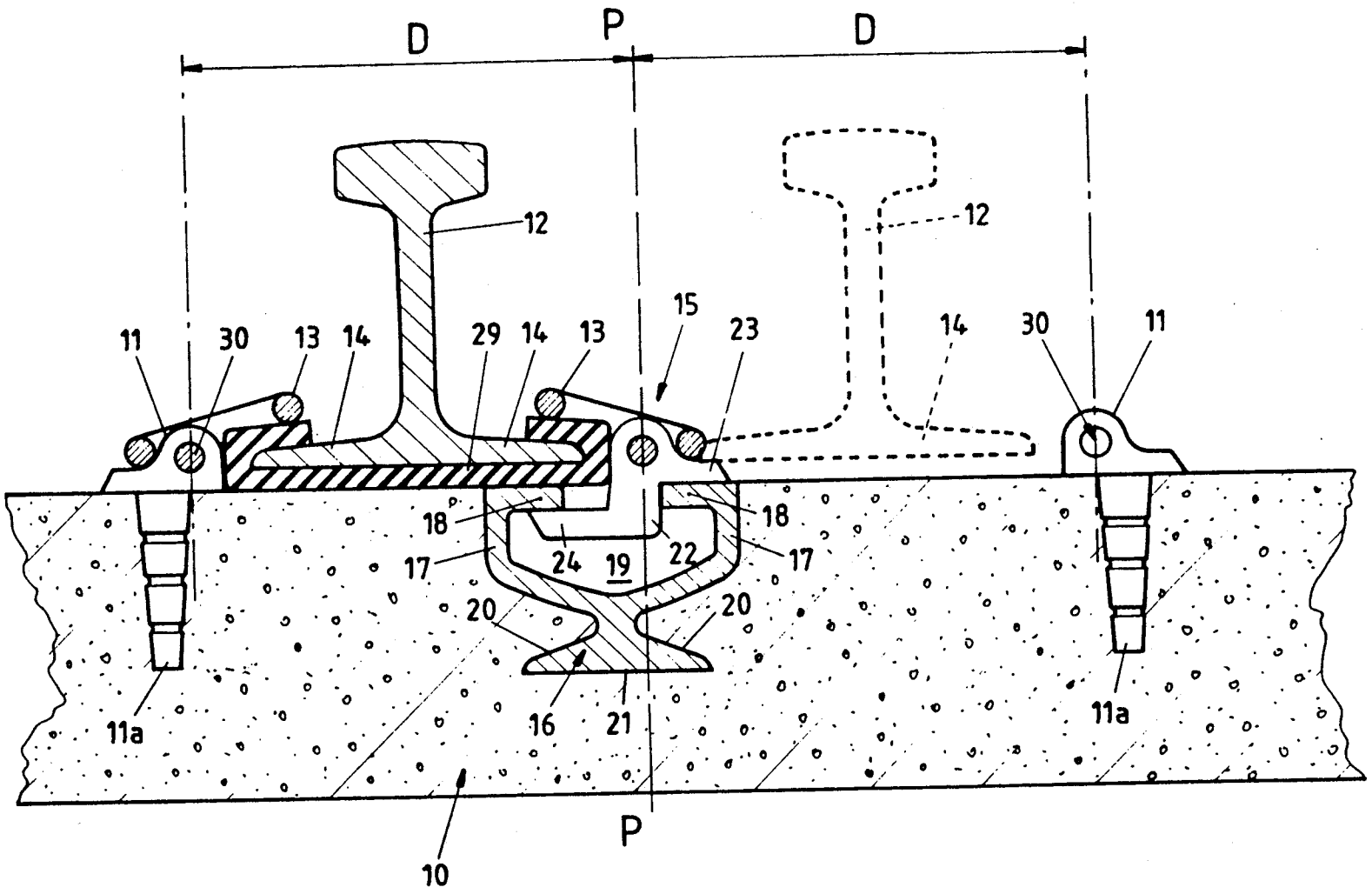
FIG. 2 is a section taken on plane 2—2—2 of FIG. 1 showing a rail which is fastened by the fastener assembly.

In this embodiment, a sleeper 10 is represented diagrammatically, and is provided with a pair of shoulders 11 cast into the concrete, a third shoulder 11 being shown in FIG. 1, and there is also provided a fourth shoulder 11 as illustrated in FIG. 2 which is usable with a rail 12 when in its broad gauge mode. The rail 12 however, is shown in dotted lines in the broad gauge mode in FIG. 2 and in full lines in the standard gauge mode.

Each of the cast-in shoulders 11 is capable of receiving a rod type resilient fastener clip 13 which will bear downwardly on the foot 14 of a rail 12, this arrangement being well known in the art and commonly used.

This invention is directed to the fastener assembly generally designated 15, and in the illustrated embodiment only one fastener assembly 15 is required. It is shown in "exploded" form in FIG. 1 and in cross-section in FIG. 2 as an assembly.

The fastener assembly 15 comprises a metal insert 16 which is embedded in the concrete of the sleeper 10 and extends in a direction across the sleeper as shown in FIG. 1. The insert 16 has side walls 17 which terminate along their upper edges in respect of inturned flanges 18 so that the insert 16 has an upwardly facing T-slot 19.

The side walls 17 are continued downwardly below the base of T-slot 19 so as to have upwardly facing keying surfaces 20 directed towards each other and which function to key the insert within the concrete. The insert length will be seen to be much less than the sleeper width, so that there is limited interference with the structural integrity of the sleeper at the locality of the insert, and in any case the insert opens to the top of the sleeper which is normally under compression forces at that locality.

There is provided a retaining block 22 which has a head 23 and a tail 24. The tail 24 bears upwardly against the undersurface of the flange 18 which is beneath the rail foot 14, and the head 23 bears downwardly on an upper surface of the other flange 18 which is outboard of the foot 14, and the shape of the head 23 is substantially similar to the shapes of the heads of the moulded end shoulders 11. The required force to maintain the rail in position is applied by the rodlike fastener clip 13 in the same way as with the other clips in the other moulded end shoulders 11. The edge 25 of the outboard flange 18 is abutted by a surface 26 of a stem portion 27 of the head 23, while the surface 28 of the head closest to rail 12 abuts the insulating pads 29 beneath the rail and thereby inhibits lateral outward movement. The aperture 30 through the head receives an end of the rodlike fastener clip 13.

The shoulders 11 at the right hand end of the sleeper as depicted in FIG. 2 are equally spaced along the sleeper 10 towards and away from the sleeper end from the insert 16, so that the distances 'D' of the centres of apertures 30 are equally spaced from the central vertical plane 'PP' of insert 16.

A consideration of the above embodiment will indicate that the invention provides an inexpensive and effective way of varying the rail retention means for broad or narrow gauge railroad track modes. The sleeper has been described with only one fastener assembly according to this invention, but obviously the sleeper can be arranged symmetrically about its central location to have the arrangement illustrated in FIG. 2 duplicated on the left hand side of the sleeper, that is, the sleeper then having two fastener assemblies which are in accordance with this invention.

I claim:

1. A railroad concrete sleeper fastener assembly comprising at least one metal insert embedded in the concrete sleeper and having a central longitudinal axis extending across the width of the sleeper, said width being defined as the dimension essentially parallel to rails laid upon said sleeper in a conventional manner, the insert having side walls with inner and outer surfaces spaced from and essentially parallel to said central longitudinal axis, the side walls terminating along their upper edges in respective in-turned flanges which define between them a T-slot with a mouth of width which is less than the space between said inner surfaces;

said outer surfaces comprising upwardly facing keying surfaces directed towards each other thereby keying the insert within concrete of the sleeper;

and at least one retaining block having a tail which bears upwardly against an upper surface of a first said flange which underlies a rail foot assembly when supported by the sleeper, a head which bears downwardly on an upper surface of the other said flange outboard of said rail foot, walls defining an aperture extending through said head in a direction also across the sleeper, a fastener retained by the aperture walls and bearing downwardly both on the rail foot and on said head, and a stem extending through said mouth and joining the head and tail of the retaining block.

2. A railroad concrete sleeper fastener assembly according to claim 1 wherein said mouth is defined by generally vertical edges of the respective said flanges, said stem also having a generally vertical edge which abuts said vertical edge of the outboard flange, and said head also having a generally vertical edge which, in use, abuts an edge of said rail foot assembly.

3. A railroad concrete sleeper fastener assembly according to claim 1 wherein said insert side walls extend into a lower flange, and said keying surfaces are surfaces of the lower flange.

4. A railroad concrete sleeper fastener assembly according to claim 1 wherein the length of the insert is less than the width of the sleeper.

5. In combination, a concrete sleeper comprising a fastener assembly according to claim 1 near one end thereof, and a pair of shoulders each having a spigot embedded in the concrete of the sleeper and a head projecting from the upper surface of the concrete sleeper, each said shoulder head having a shape essentially identical to the retaining block head as defined in claim 1, the shoulders being equally spaced along the sleeper from the fastener assembly respectively towards and away from said one end, and a further fastener selectively positioned in one of said shoulder heads cooperating with the fastener assembly of claim 1 to retain a rail in one of two gauge modes.

6. In combination, a concrete sleeper comprising a fastener assembly according to claim 5 wherein the shape of said insert is symmetrical about a vertical plane central to the insert and extending across the width of the sleeper, whereby the retaining block is positionable with its head bearing downwardly on either one of the flanges.

* * * * *

UNITED STATES PATENT AND TRADEMARK OFFICE

CERTIFICATE OF CORRECTION

PATENT NO. : 5,083,706

DATED : January 29, 1992

INVENTOR(S) : Robert L. Bratchell

It is certified that error appears in the above-identified patent and that said Letters Patent is hereby corrected as shown below:

On the Title page,

Column 1, item [54], "CONCRETE SLEEPER WITH EAST-IN INSERT COOPERATING WITH A FASTENER A ASSEMBLY" should read -- CONCRETE SLEEPER WITH CAST-IN INSERT COOPERATING WITH A FASTENER ASSEMBLY__"

Column 3, line 35, "against an upper surface" should read--against an under surface--.

Signed and Sealed this

Twenty-fifth Day of May, 1993

Michael K. Kirk

*Attest:*

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,083,706

DATED : January 28,1992

INVENTOR(S) : Robert L. Bratchell

It is certified that error appears in the above-indentified patent and that said Letters Patent is hereby corrected as shown below:

On the title page and column 1, lines 2 and 3, "CONCRETE SLEEPER WITH EAST-IN INSERT COOPERATING WITH A FASTENER ASSEMBLY" should read --CONCRETE SLEEPER WITH CAST-IN INSERT COOPERATING WITH A FASTENER ASSEMBLY--.

Column 3, Claim 1, line 35, "against an upper surface" should read --against an under surface--.

This Certificate supersedes Certificate of Correction issued May 25, 1993.

Signed and Sealed this

Second Day of November, 1993

*Attest:*

*Attesting Officer*

Bruce Lehman

BRUCE LEHMAN

*Commissioner of Patents and Trademarks*